US006558059B1

(12) United States Patent
Hillinger et al.

(10) Patent No.: US 6,558,059 B1
(45) Date of Patent: May 6, 2003

(54) GLUE GUN WITH PINCH ROLLERS

(75) Inventors: George Hillinger, 2132 Hercules Dr., Los Angeles, CA (US) 94006; Jeno Gutai, Thousand Oaks, CA (US)

(73) Assignee: George Hillinger, Los Angeles, CA (US)

( * ) Notice: Subject to any disclaimer, the term of this patent is extended or adjusted under 35 U.S.C. 154(b) by 6 days.

(21) Appl. No.: 10/078,967

(22) Filed: Feb. 20, 2002

(51) Int. Cl.[7] ..... A46B 11/08; A47L 13/32; B43M 1/02

(52) U.S. Cl. ..... 401/2; 401/1; 222/146.2; 222/146.5

(58) Field of Search ..... 401/1, 2; 222/146.2, 222/146.5, 271; 219/227, 241

(56) References Cited

U.S. PATENT DOCUMENTS 4,059,204 A * 11/1977 Duncan et al. ..... 222/146.5
4,938,388 A * 7/1990 Yeh ..... 401/2
5,012,953 A * 5/1991 Borst et al. ..... 222/146.2
5,779,103 A * 7/1998 Massena ..... 222/146.5

* cited by examiner

*Primary Examiner*—Tran Nguyen
(74) *Attorney, Agent, or Firm*—Robert R. Thornton

(57) ABSTRACT

A glue gun has a base adapted to receive electrical power in either cordless or corded operation, a barrel, a feed roller, a selectively removable glue stick holder in axial alignment with and disposed between a nozzle assembly and the feed roller and extending through an electric heater for containing a glue stick to be melted by the heater, a pinch roller adapted to press the glue stick against the feed roller so that rotation of the feed roller causes the glue stick to be urged toward the nozzle assembly in order to extrude melted glue therethrough, the nozzle assembly having a longitudinal passageway which is normally closed by a pair of valves serially disposed at opposite ends of the passageway and which are operable to open in response to pressure from melted glue produced by rotation of the feed roller and to close to trap melted glue in the passageway when feed roller rotation is terminated, and a trigger assembly to manually control the application of electric power to a drive motor to rotate the feed roller.

6 Claims, 7 Drawing Sheets

GLUE GUN WITH PINCH ROLLERS

BACKGROUND OF THE INVENTION

The present invention relates to hand tools, and more particularly to hand-held cordless or corded adhesive dispensers using electrically generated heat to melt the adhesive, which is in stick form. Such tools are commonly referred to as "glue guns."

Glue guns are well known in the art, and various configurations for corded glue guns are illustrated in the following U. S. Pat. Nos.: 3,604,597, issued Sep. 14, 1971 to Harold E. Pohl et al.; U.S. Pat. No. 4,523,705, issued Jun. 18, 1985 to Richard W. Belanger et al., and U.S. Pat. No. 5,215,230, issued Jun. 1, 1993 to Grace Lee. In all of these patents, an electrical supply cord is permanently attached to the handle of the glue gun to provide, on demand, electrical current to a heater in the gun to melt a portion of an adhesive which is then expelled through a nozzle at the outer end of the "barrel" of the glue gun. Such corded guns for direct connection to an electrical power outlet by an electrical cord are well known in the art and are widely sold throughout the world at present in many different configurations.

A variation of this type of electrical current supply is shown in U. S. Pat. No. 4,826,049, issued May 2, 1989 to Howard D. Speer, in which the gun is placed in a base containing the electrical current source, and the melting of the adhesive occurs while the gun remains in the base. Removal of the gun from the base terminates the flow of the current through the heating element utilized to melt the adhesive.

Cordless type glue guns differ from the preceding types in that the gun contains a power source, a rechargeable battery, which is used to supply the current, on demand, to melt the adhesive. Such guns normally include a stand which contains a battery recharging circuit connected to a source of electrical power, so that when the gun is replaced in the stand after use, the battery is recharged. Such cordless guns and recharging systems are well known in the art and are widely sold throughout the world at present in many different configurations.

Whether corded or cordless, all glue guns have certain characteristics in common. They have a hand gun-like shape with a pistol grip which is grasped by the user when the gun is in use. The gun contains an electrical heater element, typically located in the gun "barrel." The adhesive is in a solid stick form which extends through the barrel adjacent the heater element and is "melted" by the selective application of electrical power to the heater element. Application of the electrical power is controlled by a trigger mechanism. The gun barrel terminates in a nozzle, through which the molten adhesive is extruded by pressure applied to the adhesive stick by one or more of a variety of linkages actuated by actuation of the gun trigger. The nozzle typically includes a spring-loaded ball check valve in an effort to terminate the flow of molten adhesive as soon as pressure on the trigger is released, in an attempt to avoid molten adhesive dripping from the nozzle thereafter.

Corded and cordless glue guns each have their own advantages with respect to one another. For example, cordless guns provide portability for use on sites remote from an electrical outlet, while corded guns provide for continuous use without the necessity of recharging or changing the battery. Consequently, a user may utilize one of each type of gun to provide for maximum flexibility in performing work.

SUMMARY OF THE INVENTION

According to the present invention, a glue gun, suited for either cordless or corded operation, has a gun casing with a base and a barrel, the base being adapted to receive electrical power from a power source which is either a battery or an ac to dc converter; a heater element housing containing a heater element; a drive motor; electrical circuit means for applying electrical power to the heater element and to the drive motor; a feed roller disposed within the casing so as to be transverse to and in longitudinal alignment with the barrel and operable, in response to the selective application of electrical power to the drive motor, to be rotated thereby in a preselected direction, the barrel terminating in a nozzle remote from the feed roller; a removable glue stick holder disposed within the barrel in axial alignment with and between the nozzle and the feed roller so that a glue stick, when disposed within the glue stick holder, extends from the nozzle through the glue stick holder onto and beyond the feed roller; and a pinch roller for pressing the glue stick, when so disposed, against the feed roller when electrical power is applied to the drive motor, to assist in the urging the glue stick toward the nozzle in response to rotation of the feed roller in the preselected direction. In the presently preferred embodiment, the glue stick holder, which extends through the heater element, includes a peripheral stop ring to prevent the glue stick, as it is being fed toward the nozzle, from moving the glue stick holder through the heater.

BRIEF DESCRIPTION OF THE DRAWINGS

The invention may be more readily understood by referring to the accompanying drawings, in which.

DETAILED DESCRIPTION OF THE PREFERRED EMBODIMENTS

Figure 1:
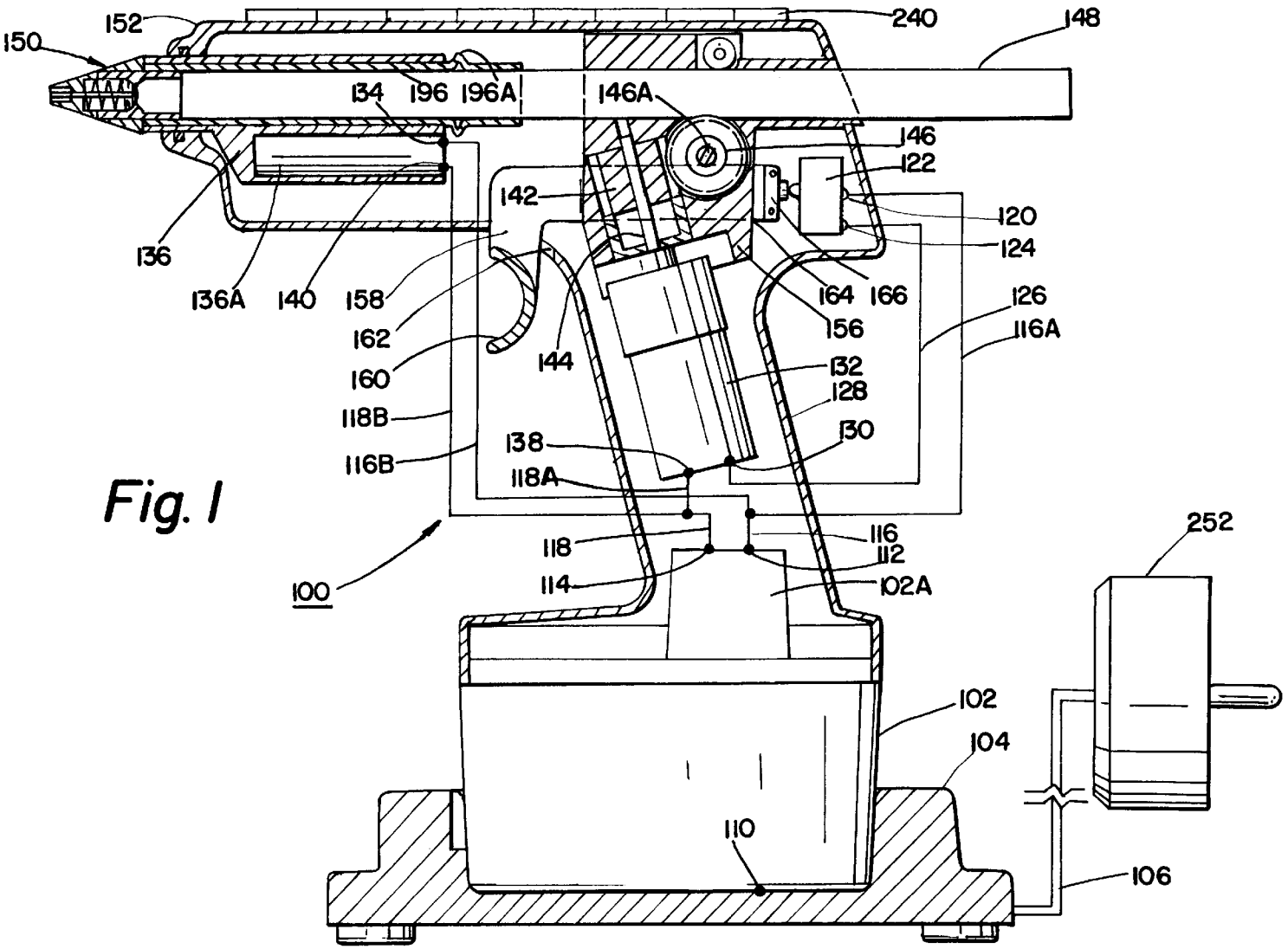
FIG. 1 is a left side elevational view, in section, of a glue gun according to the present invention, in which the gun is shown as including a battery and battery charger for cordless operation of the glue gun.

Referring first to FIGS. 1, 2, 4 and 5, a glue gun 100 includes a conventional rechargeable battery 102 and, in FIG.1, is shown as stored in a stand 104 (shown for illustrative purposes only in section in FIG. 1). The stand 104 includes an electrical power lead 106 connected to a conventional ac to dc converter 252 to supply dc power to the battery 102, for recharging. The electrical circuitry for such converters is well known in the art, and so is not shown in FIG. 1. The stand 104 has output terminals 110 through which the dc output of the charger 104 is applied to the battery 102 to recharge it. The battery 102 has a plug-in element 102A with a pair of output terminals 112, 114, shown schematically in FIG. 1, which plug into the gun 100 in a suitable recess so as to be in electrical contact with electrical leads 116, 118, also shown schematically, to provide electrical power to the gun 100. It will be understood that a third lead (not shown) may normally be utilized, when desired or required, as the case may be, in conventional fashion to meet electrical codes as to grounding.

Figure 15:
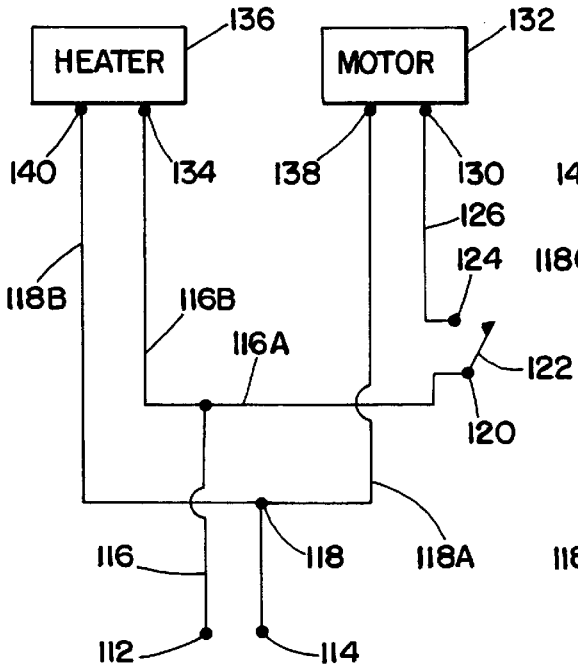
FIG. 15 is a schematic diagram of the presently preferred embodiment of the electrical circuit of the glue gun as illustrated in FIG. 1.

The lead 116 has two branches, 116A and 116B. Lead branch 116A is connected to an input terminal 120 of a miniature switch 122 of conventional design, whose output terminal 124 is connected to a lead 126. The gun 100 has an outer casing 128, shown in section, to which the switch is fixed in conventional fashion. The lead 126 is shown in FIG. 1, schematically, as connected to an input terminal 130 of a drive motor 132. Lead branch 116B is shown as connected to an input terminal 134 of an electrical heater element 136A, which is contained in a heater element housing 136. The lead 118 has a branch 118A, which is shown, schematically, as connected to an output terminal 138 of the drive motor 132, and a branch 118B, which is shown as connected to an output terminal 140 of the heater element 136A. FIG. 15 is a schematic diagram of this circuitry.

A worm gear 142 is fixed to a drive shaft 144 which is driven by the drive motor 132. A feed roller 146, mounted on an axle 146A, engages the worm gear 142 in conventional fashion, so that rotation of the worm gear 142 in a predetermined direction rotates the feed roller 146 in a counterclockwise direction, thereby causing a glue stick 148, which is engaged by the feed roller 146, to be urged through the heater element housing 136 toward a nozzle assembly 150 in which a barrel portion 152 of the outer casing 128 terminates. In the preferred embodiment, a pinch roller assembly 154 urges the glue stick 148 against the feed roller 146 (see FIG. 4), so as to assist in urging the glue stick 148 toward the nozzle assembly 150 upon the counterclockwise rotation of the feed roller 146, as will be described hereinafter specifically with respect to FIGS. 4 and 5. The motor 132, drive gear 142 and worm gear 146 are attached to a motor and gear housing 156, which is fixed to the casing 128 by any conventional means so as to be supported therein.

Figure 4:
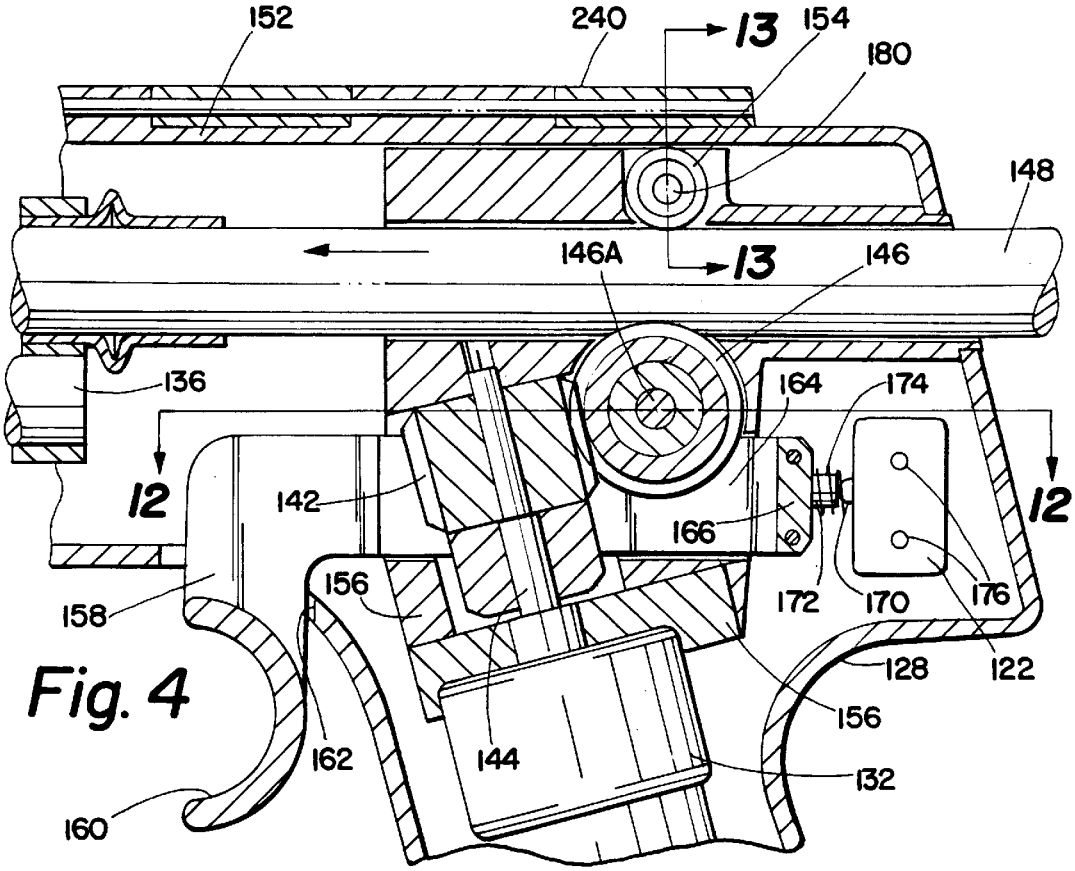
FIG. 4 is a partial sectional view of the gun of FIG. 1 illustrating the gun trigger mechanism in its actuated disposition.
Figure 5:
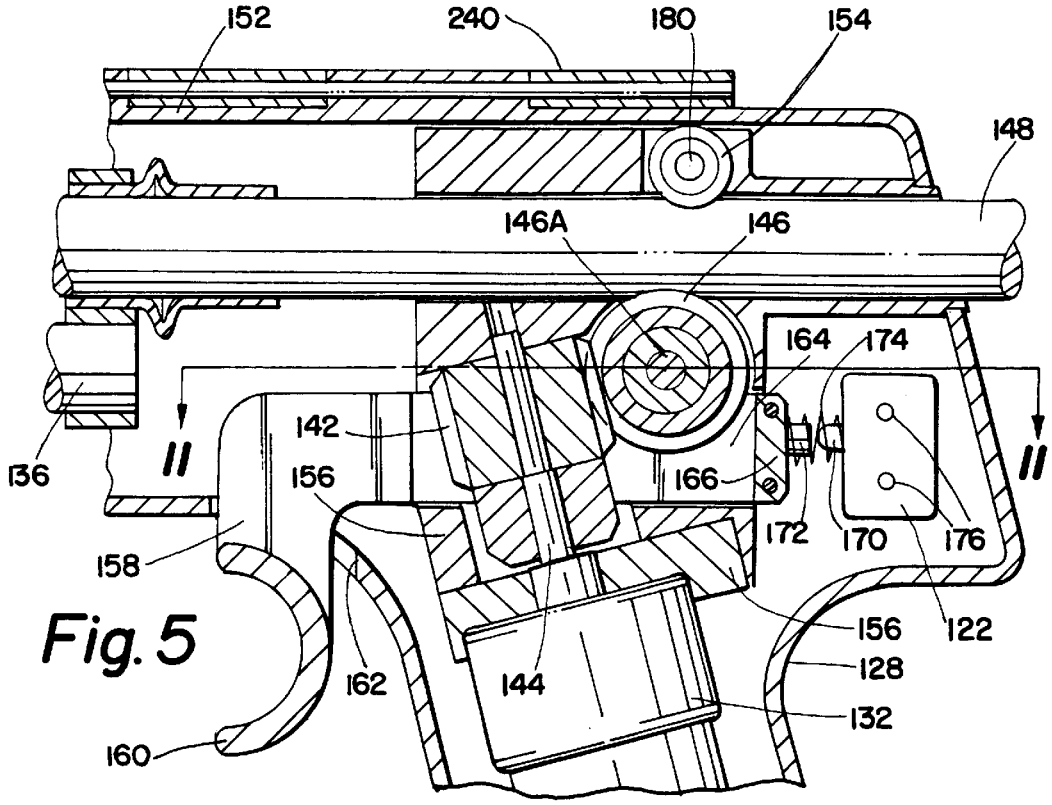
FIG. 5 is a view, similar to FIG. 4, but illustrating the trigger mechanism in its released disposition.
Figure 9:
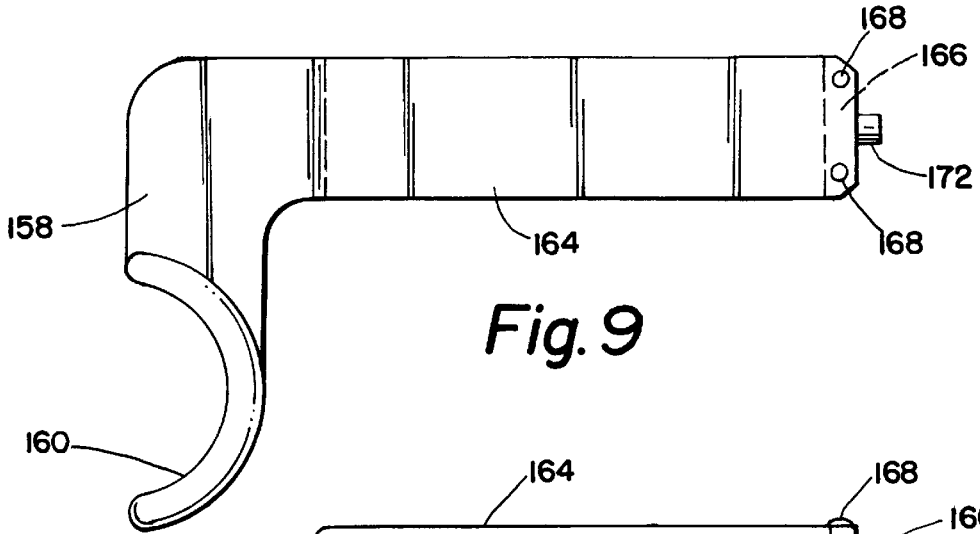
FIG. 9 is a left side elevational view of a trigger fork for use with the glue gun of FIG. 1.
Figure 10:
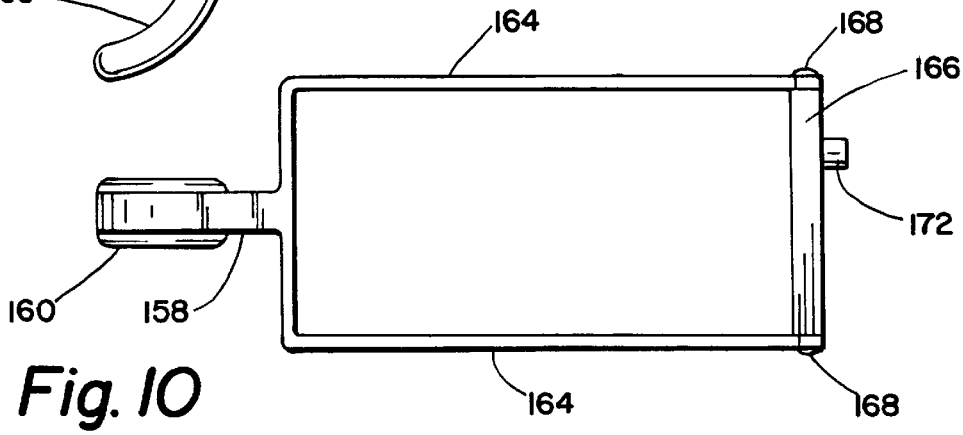
FIG. 10 is a top plan view of the trigger fork shown in FIG. 13.
Figure 11:
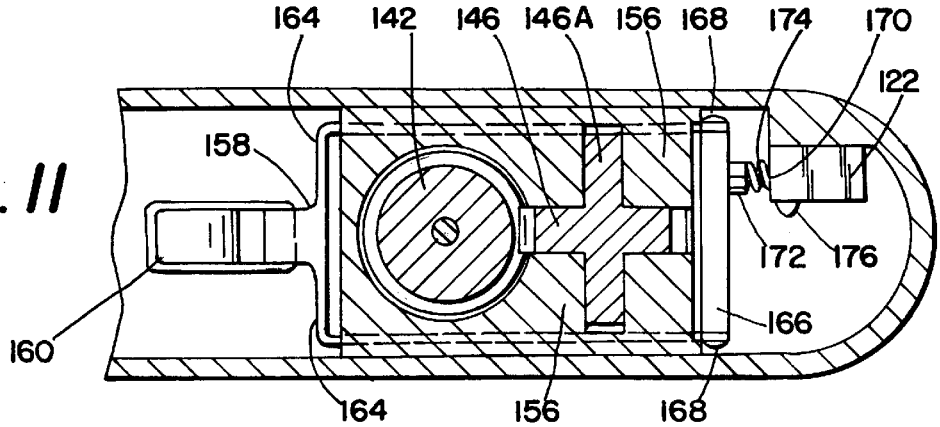
FIG. 11 is a partial plan view, in section, of the glue gun of FIG. 1, taken along lines 11—11 of FIG. 4.
Figure 12:
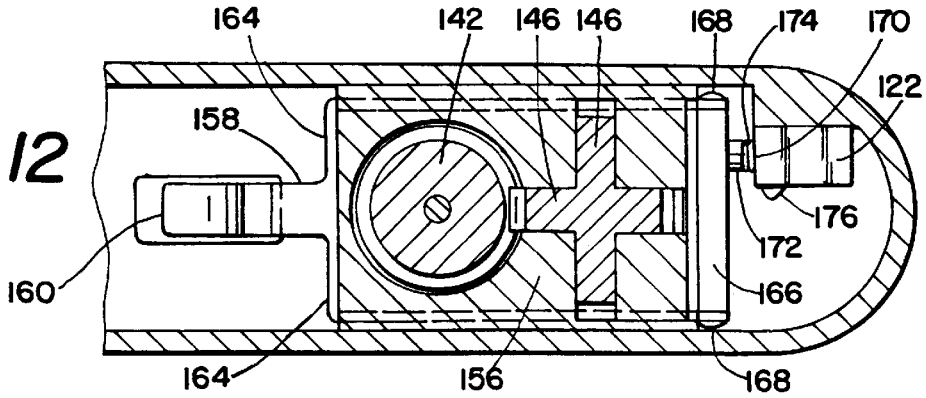
FIG. 12 is a partial plan view, in section, of the glue gun of FIG. 1, taken along lines 12—12 of FIG. 5.

As is best seen in FIGS. 4 and 5, a trigger fork 158 (shown in detail in FIGS. 9 and 10) has a trigger 160 which extends through a trigger aperture 162 in the casing 128. The trigger fork 158 has a pair of trigger arms 164 (see FIG. 10) between which a cross-arm 166 extends and is attached thereto by four bolts 168 in conventional fashion, as is shown in FIGS. 9 and 10, so as to straddle the worm gear 142, see FIGS. 11 and 12. The switch 122 has an actuator element 170 which, when contacted by an actuator boss 172 formed on the rear surface of the cross-arm 166 by reason of pressure applied to the trigger 160 as shown in FIG. 4 overcoming the biasing of a trigger bias spring 174, closes the switch 122 to complete the electrical circuit between the leads 116, 126, applying electrical power to the motor 132, which rotates the feed roller 146 in a counterclockwise direction to urge the glue stick 148 toward the heater element housing 136 (FIG. 1).

When the pressure on the trigger 160 is released, the cross-arm 166 moves away from the switch 122, opening the electrical circuit to remove power from the motor 132. The feed roller 146 no longer urges the glue stick 148 toward the nozzle assembly 150. The switch 122 is fixed to the casing 128 by a pair of bolts 176 in conventional fashion.

Referring back to FIG. 1, a removable cylindrical glue stick holder 196 is positioned within a complementary passageway in the heater assembly 136 so as to extend through the heater assembly 136 at the forward end of the barrel portion 152 and engages the nozzle portion 150. The glue stick 148 extends through the length of the glue stick holder 196. A peripheral stop ring 196A formed on the glue stick holder 196 prevents the glue stick 148, as it is urged forward toward the nozzle portion 150 by the feed roller 146 upon actuation of the glue gun 100, from carrying the glue stick holder 196 into the heater element assembly 136. When it is necessary or the user desires to replace or change the glue stick 148, the gun 100 is opened to the disposition shown in FIG. 2, and the glue stick holder 196 manually moved axially away from the nozzle assembly 150 and withdrawn from the heater assembly 136, and either a different glue stick holder 196 and glue stick 148 is inserted in its place, or the existing glue stick 148 is withdrawn from the existing glue stick holder 196, and replaced by a new glue stick of the desired characteristics, and the existing glue stick holder 196 reinserted into the heater assembly 136, as shown in FIG. 1.

Figure 6:
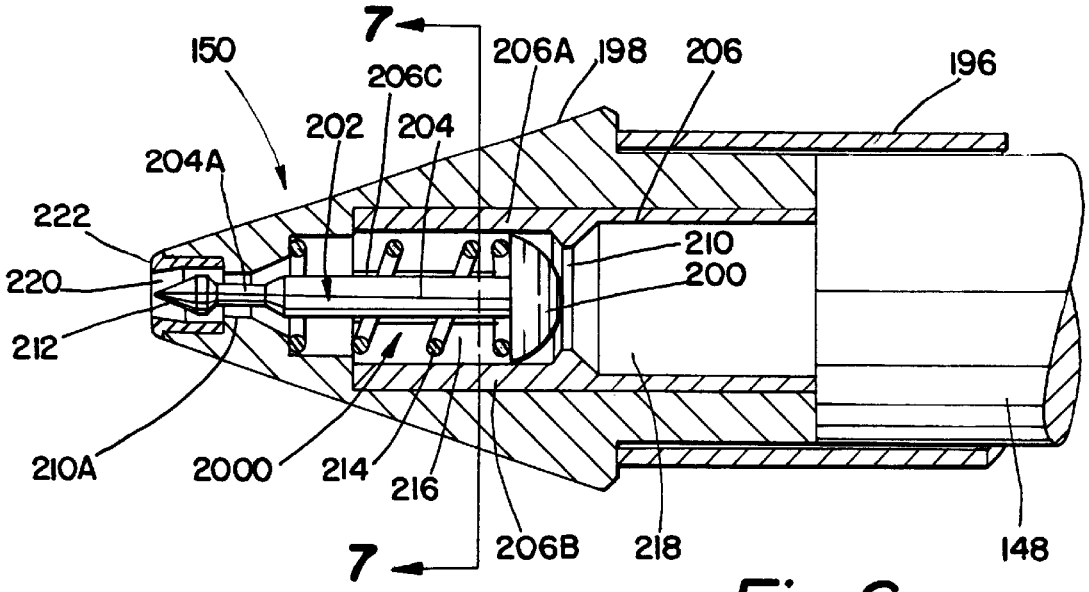
FIG. 6 is a partial sectional view of the glue dispensing nozzle of the gun of FIG. 1 when glue is being dispensed.
Figure 7:
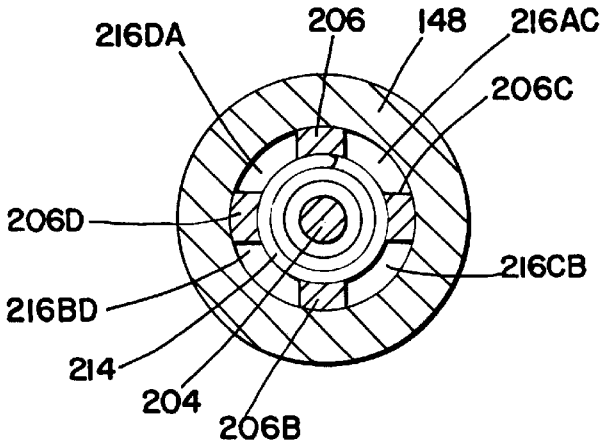
FIG. 7 is a view, in section, taken along lines 7—7 of FIG. 6.
Figure 8:
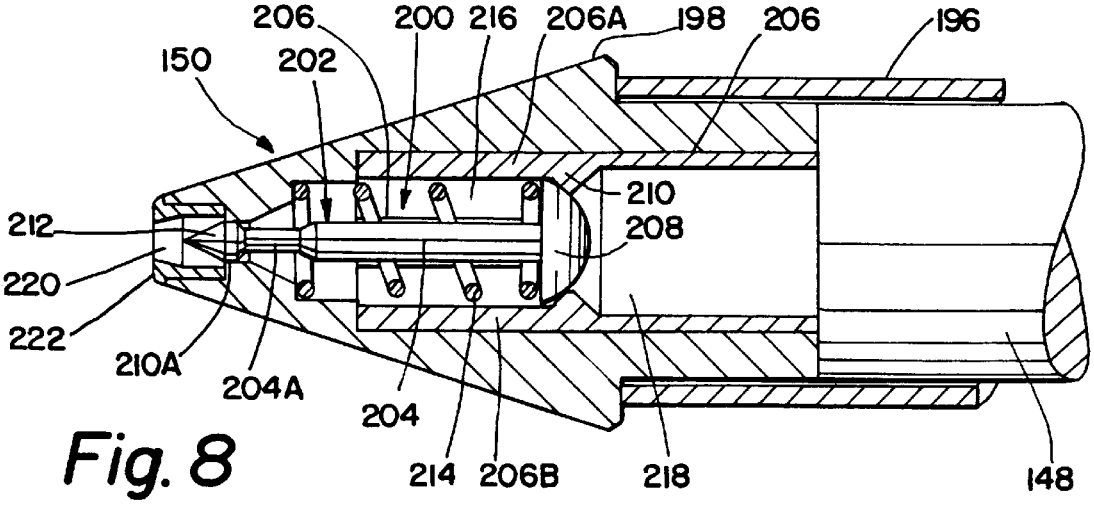
FIG. 8 is a partial sectional view, similar to FIG. 6, but showing the glue dispensing nozzle when glue is not being dispensed.

Referring now to FIGS. 6, 7 and 8, which are detail drawings of the nozzle assembly 150 in its opened (glue dispensing) disposition (FIG. 6) and in its closed disposition (FIG. 8), the nozzle assembly 150 includes a nozzle proper 198, which abuts the glue stick holder 196. The nozzle proper 198 has a longitudinal passageway 200 extending therethrough, within which a valve assembly 202, including a valve stem 204, is disposed within a valve insert 206. The valve stem 204 terminates at its upstream end in a parti-spherical first valve head 208. Formed in the valve insert 206 adjacent the upstream end of the valve stem 204 is an annular first valve seat 210. The first valve head 208 seats against the first valve seat 210 when the valve assembly 202 is in its closed disposition (FIG. 8), so as to form a first closure of the longitudinal passageway 200.

The opposite (downstream) end of the valve stem 204 is chamfered into a reduced cross-section valve stem portion 204A, which terminates in a second valve head 212, parti-spherical and parti-conical in its longitudinal configuration. When the valve assembly 202 is in its closed disposition (FIG. 8), the second valve head 212 seats against an annular second valve seat 210A, which is formed in the nozzle proper 198, so as to form a second (downstream) closure of the longitudinal passageway 200. The valve assembly 202 is normally biased to its closed disposition (FIG. 8) by a valve bias spring 214, through which the valve stem 204 extends.

The valve insert 206 has four guide elements 206A, 206B, 206C, 206D (FIG. 7), formed downstream of the first valve seat 210, which serve to engage the periphery of the first valve head 208 so as to maintain the axial alignment of the valve stem 204 and so the valve heads 208, 212 with respect to the axis of the longitudinal passageway 200.

A glue passageway 216 (FIGS. 6, 8) is formed within the valve insert 206 downstream of the first valve head 208. When the first valve head 208 is unseated from the first valve seat 210 (FIG. 6), melted glue from the glue stick 148, which has filled a glue inlet space 218 formed immediately upstream of the first valve seat 210 in the valve insert 206, passes into the glue passageway 216 around the first valve head 208 through glue passages 216AC, 216CB, 216BD, 216DA formed between the guide elements 206A, 206B, 206C, 206D, as is shown in FIG. 7. After passing into the glue passageway 216, the melted glue passes out of the nozzle proper 198 through the second valve seat 210A and an outlet passage 220 formed at the downstream end of the nozzle proper 198 by an outlet insert element 222.

Figure 13:
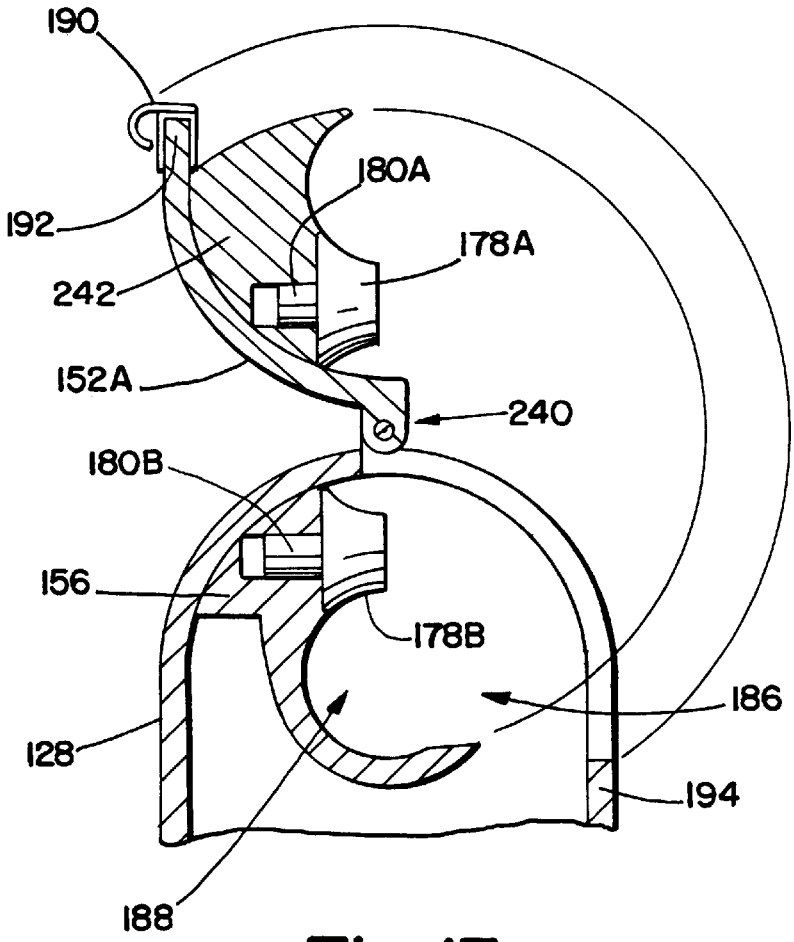
FIG. 13 is a partial front elevational view, partially in section of a pinch roller assembly for use with the glue gun of FIG. 1, with the hinged barrel portion of the glue gun in its opened disposition for receiving a glue stick.

As is shown in FIGS. 1, 2, 9, and 10, the glue gun barrel 152 has a hinge 240 extending along the barrel top (the hinge 240 being omitted in FIGS. 4 and 5 for purposes of clarity). A hinged barrel portion 152A (FIGS. 2, 13), comprising the upper left hand portion of the barrel 152, is attached to the hinge 240, so as to be selectively rotated away from a position adjacent the remainder of the barrel 152, as is best seen in FIG. 13, so as to permit access to the glue stick holder 196. The hinged barrel portion 152A has a glue stick pressure pad 242 at the rear thereof to engage the glue stick 148 when the hinged barrel portion 152A is in its closed disposition (see FIG. 13) so as to close the opening 186 in a longitudinal passageway 188 extending through the motor gear housing 156 to hold the glue stick 148 in place during operation of the glue gun 100. A similar glue stick holder pressure pad 244 (FIG. 2) on the hinged barrel portion 152A performs the same function with respect to the glue stick holder 196 adjacent the nozzle portion 150. A clip 190 FIG. 13) extends substantially the length of the hinged barrel portion 152A and is press-fitted onto a lip 192 formed thereon so as to frictionally engage a lip 194 formed on the casing when the hinged portion 152A is rotated clockwise so as to close the passageway 188 and apply pressure to the glue stick holder 196 during operation of the glue gun 100.

Figure 14:
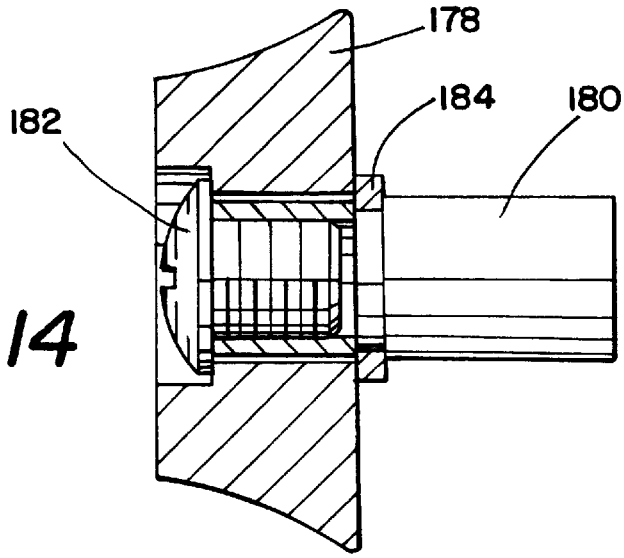
FIG. 14 is a partial sectional view of one of the pinch rollers shown in FIG. 13, illustrating its attachment to its mounting axle.

The pinch roller assembly 154 is shown in detail in FIG. 13, which is a partial rear elevational view, partially in section, taken along lines 13—13 of FIG. 4. The pinch roller assembly 154 consists of a pair of oppositely disposed bell-shaped rollers 178A, 178B, mounted on an axle 180. The axle 180 consists of a pair of axle members 180A, 180B, to which the rollers 178A, 178B are attached by means of a pair of bolts 182 in conventional fashion. FIG. 14 is a partial sectional view of one of the pairs of rollers 178A, 178B and axles 180A, 180B, which as assembled are mirror images of one another, illustrating the attachment of the rollers and axles through the use of the bolts 182 and washers 184, to provide for the rotatability of the rollers.

As will be apparent from the foregoing the operation of the glue gun is as follows:

When the trigger 160 is pulled, trigger arms 164 move the cross-arm actuator boss 172 toward and into contact with the switch actuator element 170, overcoming the bias of the trigger bias spring 174, and closing the electrical circuit through the switch 122 to apply electrical power to the drive motor 132, whose drive shaft 144 drives the worm gear 142 which in turn, rotates the feed roller 146 to urge the glue stick 148 toward the nozzle assembly 150 as shown by the arrow in FIG. 4. Melted glue from the glue stick 148, which has filled the glue inlet space 218, is then forced against the first valve head 208, overcoming the valve closing bias of the valve bias spring 214 so as to open the first valve seat 210. Melted glue then flows into the passageway 220 in response to the urging by the rotation of the feed roller 146 of the glue stick 148 toward the nozzle assembly 150 The melted glue in the passageway 200 then flows through the second valve seat 210A, which has been opened by the action of the valve stem moving the second valve head 212 in response to the movement of the first valve head 208 away from the first valve seat 210. The melted glue then flows into the outlet passage 220 around the second valve head 212 and out of the nozzle assembly 150.

In conventional glue guns, one of the problems often encountered is the continued passage of melted glue out of the dispensing nozzle after the trigger is released. The glue gun 100 solves this problem in the following manner:

When the trigger 160 is released, the trigger bias spring 174 immediately urges the cross arm 166 away from the switch 122, thereby opening the switch 122 and terminating the application of electrical power to the drive motor 132, to terminate the urging of the glue stick 148 toward the nozzle assembly 150, so as to immediately terminate the pressure applied to the first valve head 210 by the melted glue, whereupon the urging of the valve bias spring 214 causes the first valve head 208 to close the first valve seat 210 and the valve stem 204 to move the second valve head 212 so as to close the second valve seat 210A, trapping substantially all of the melted glue in the nozzle assembly within the passageway 200 until the trigger 160 is pulled again.

Figure 3:
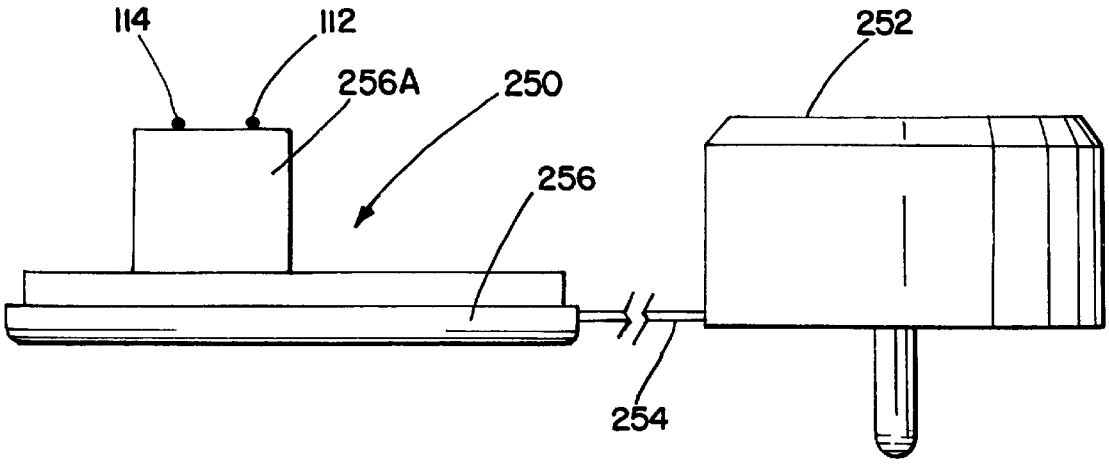
FIG. 3 is a left side elevational view of an ac adapter and stand for use with the gun of FIG. 1 to replace the battery and battery charger so as to provide for corded operation of the gun.
Figure 2:
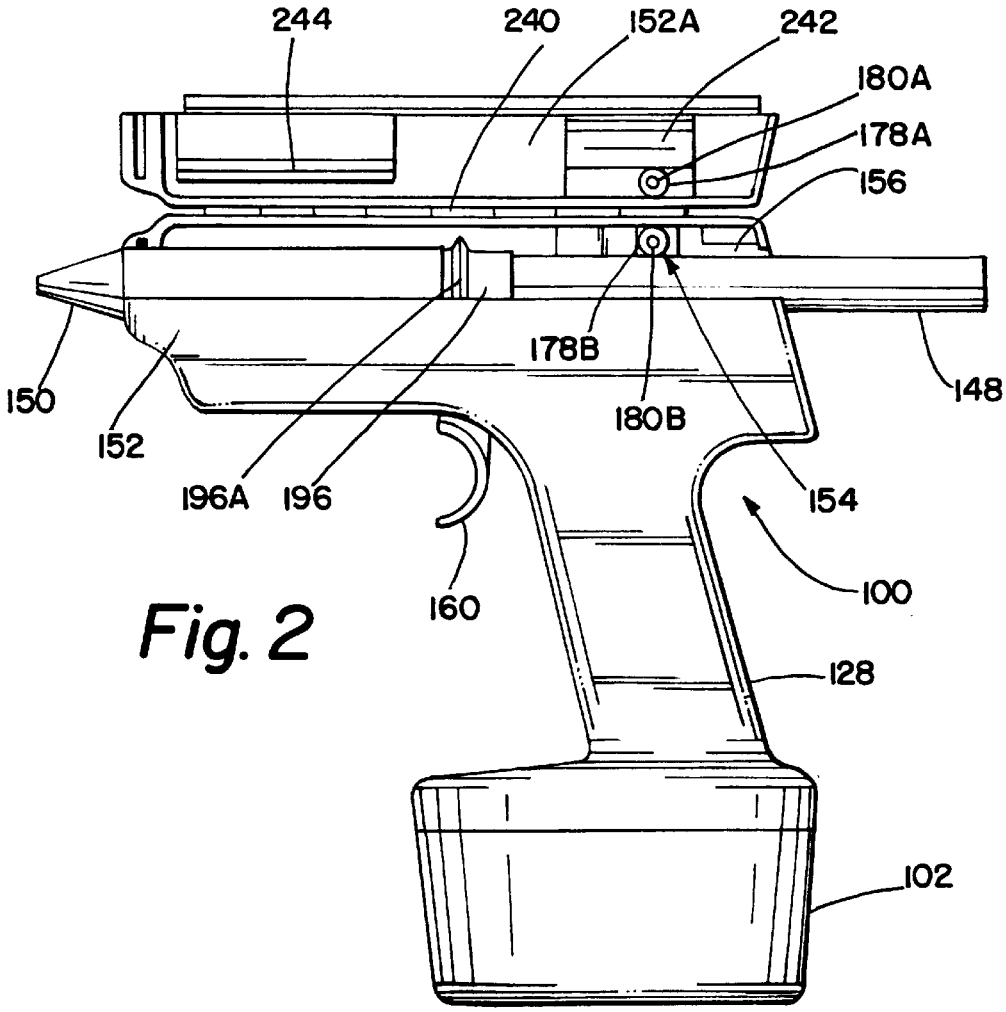
FIG. 2 is a left side elevational view of the gun shown in FIG. 1, but with the barrel opened to illustrate the positioning of a glue stick in the gun.

While the operation of the glue gun 100 has been described with respect to the utilization of the battery 102 as the source of electrical power for the motor 132 and heater element 136A, the cordless glue gun of the present invention is equally adapted for use as a corded glue gun. To this end, FIG. 3 illustrates an ac to dc converter 252, a power cord 254, an adapter base 256 to supply dc electrical power to the glue gun 100 through a plug-in element 256A, similar to the plug-in element 102A of FIG. 1. The adapter base 256 includes output terminals 112, 114 to make electrical contact between the power conversion circuitry and the electrical circuitry of the glue gun 100, as is shown in FIG. 1, with the battery 102 and stand 104 being replaced by the corded adapter 250 (FIG. 3). Operation of the corded version of the glue gun 100 is otherwise identical to the operation of the cordless version described above.

FIG. 15 is an electrical schematic diagram of the glue gun 100 as shown in FIG. 1. In this embodiment, electrical power is supplied to the heater element 136A continuously, so long as the battery 102 retains an electrical charge. When the glue gun 100 is placed in the battery charger 104, the battery 102 is recharged, and remains fully charged even though the heater element 136A remains heated.

Figure 16:
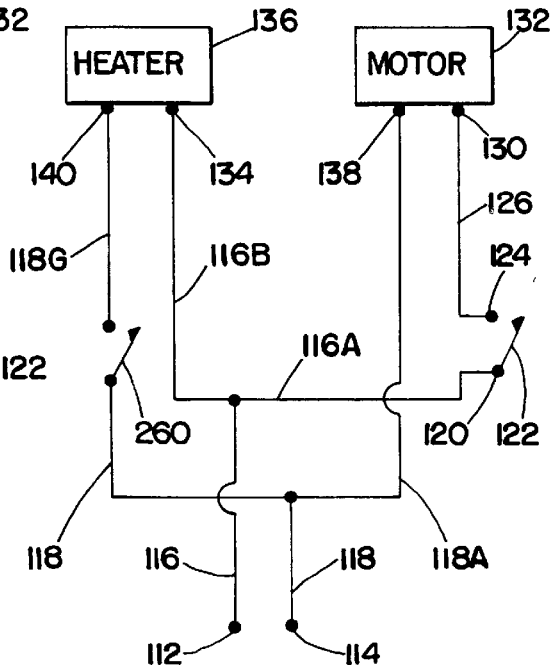
FIG. 16 is a schematic diagram of an alternate embodiment of the electrical circuit of a glue gun according to the present invention.

FIG. 16 is a schematic diagram of an alternate embodiment of electrical circuitry for the glue gun of the present invention, in which the electrical power is only applied to the heater element when the glue gun is placed in the charger stand 104 or when the trigger is pulled when in cordless operation, but continuously from output terminals 110 when the corded adapter 250 is utilized (not shown in FIG. 3, see FIG. 1). In FIG. 16, like reference numbers refer to like elements with respect to FIGS. 1 and 15. A branch lead 116C connects the lead 116 to a branch lead 116D and a branch lead 116E. The branch lead 116D is connected to an appropriate terminal of the output terminals 110. The branch lead 116E is connected to the heater element input terminal 134. A branch lead 118C connects the lead 118 to a branch lead 118D and a branch lead 118E. Diodes 116F and 118F are included in the branch leads 116C and 118C to prevent reverse flow of electrical current from the output terminals 110 through the branch leads 116C, 118C to the output terminals 112, 114 when the glue gun is in its stand. As will be apparent, so long as the glue gun is in the battery charger 104 (FIG. 1) in the corded adapter 250 (FIG. 3), and electrical current is being supplied by the converters 252, electrical current will be applied to the heater element 136A. However, when the gun is removed from the charger 104 in cordless operation, current flow through the heater element 136A is terminated until either the trigger is pulled so as to close the switch 122 or the gun is returned to the charger 104, so as to avoid discharging the battery 102 unnecessarily.

Both the embodiments of FIG. 15 and FIG. 16 provide for the continuous heating of the heater element 136A in either cordless or corded operation, so long as the glue gun is placed in the battery charger 104 or the adapter stand 250 with dc power applied thereto.

Figure 17:
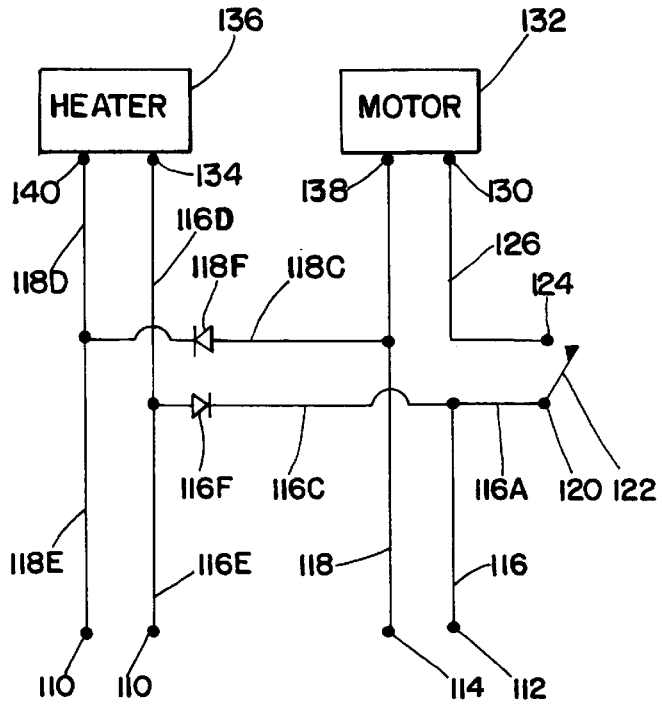
FIG. 17 is a schematic diagram of another alternate embodiment of the electrical circuit of a glue gun according to the present invention.

FIG. 17, in which like reference numbers refer to like components with respect to FIGS. 15 and 16, is a schematic diagram of another alternate embodiment of electrical circuitry for the glue gun of the present invention. In the embodiment of FIG. 17, electrical current is selectively applied to the heater element 136A, whether in cordless or corded operation, by means of a switch. As illustrated in FIG. 17, a switch 260 is connected by a branch lead 118G to the heater element output terminal 140 and by a branch lead 118H to the lead 118.

While the switch 260 is shown in FIG. 17 as being placed between the output terminal 140 and the lead 118, alternatively, it could equally well be placed in the lead 116B so as to be located between the heater input terminal 134 and the lead 116. In either embodiment, the switch 260 is manually operated by the user as desired to apply electrical current to the heater element 134 or remove the application of such power. This embodiment is particularly useful when the glue gun of the present invention, whether being used either in cordless or corded operation, will only be used intermittently, with long periods of inactivity, so that there is no necessity for maintaining the glue adjacent the glue stick constantly in a molten condition. The user can turn off the application of electrical power to the heater element 136A by opening the switch 260. At such time as the user desires to operate the glue gun, the switch 260 is closed to melt the glue stick, and the trigger pulled to close the switch 122 to initiate the extrusion of melted glue from the gun.

Figure 18:
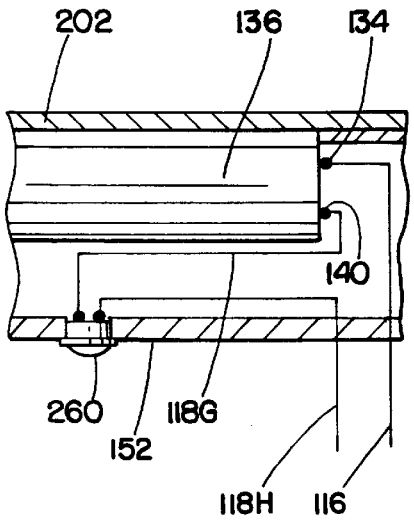
FIG. 18 is a partial view, in section, of a glue gun utilizing the embodiment of electrical circuitry of FIG. 17, illustrating its implementation in the glue gun of FIG. 1 by providing a switch on the barrel adjacent the glue gun's heater element assembly.

FIG. 18 is a partial view, in section, of a glue gun utilizing the embodiment of electrical circuitry of FIG. 17, illustrating its implementation in the glue gun of FIG. 1, in which like reference numbers refer to like parts with respect to FIGS. 1 and 17. As illustrated in FIG. 18, the switch 260 is located on the exterior of the barrel 152 below the heater element 136A, although this location is for illustrative purposes only. Obviously, the switch could be placed at any location on the glue gun deemed convenient for the user. The switch 260 may be any of the wide variety of conventional commercially available switches designed for handling the voltage and wattage involved. While the switch 260 is shown in FIG. 23 as a push-button type switch, such is for illustrative purposes only and not by way of limitation. For example a slide type switch, which can also change the amount of power, for reducing the temperature (rheostat), could equally well be utilized, as is well known in the art as the equivalent thereof.

Although the presently preferred embodiments of the invention have been set forth herein in detail for illustrative purposes only, it will be apparent to those skilled in the art that variations and modifications thereof, including the rearrangement of parts, lie within the scope of the present invention, which is not limited to the specific structures of the embodiments shown or described herein, but only by the scope of the following claims.

The invention claimed is:

1. In a glue gun, the combination of:

a gun casing with a base adapted to receive electrical power from an electrical power source and a barrel with a longitudinal axis terminating in a nozzle assembly through which melted glue may be selectively dispensed;

a heater element assembly disposed within the barrel adjacent the nozzle assembly and including an electrical heater element adapted to heat a glue stick selectively removably contained within the heater element assembly;

a drive motor;

electrical circuit means for applying the electrical power to the heater element and, selectively, to the drive motor;

a feed roller disposed within the casing so as to be transverse to and in longitudinal alignment with the barrel and operable, in response to the selective application of electrical power to the drive motor, to be rotated thereby in a preselected direction;

a generally cylindrical glue stick holder disposed within the heater element assembly in axial alignment with and between the nozzle and the feed roller and operable to permit the manual selective removal of the glue stick from the heater assembly, whereby the glue stick, when disposed within the glue stick holder, normally extends from adjacent the nozzle through the heater element assembly onto and beyond the feed roller;

pinch roller means normally operable to press the glue stick, when so disposed, against the feed roller, whereby the glue stick is urged toward the nozzle in response to rotation of the feed roller in the preselected direction;

the barrel has a hinge extending longitudinally along a portion of a barrel top, the barrel having a first barrel side which is fixed with respect to the heater assembly and a second barrel side which is connected to said hinge so as to be selectively rotatable through an arc between: a first disposition which is adjacent the heater assembly, and a second disposition which is remote from the heater assembly to permit access to the glue stick holder; wherein the pinch roller means comprises:

(a) first and second roller elements which are mirror images of one another and whose outer glue stick engaging surfaces are complementary to their respective peripheral portions of the glue stick to be pinched, (b) first axle means on which the first roller element is rotatably mounted so as to be fixed with respect to the first barrel side and transverse to the glue'stick, and (c) second axle means on which the second roller element is rotatably mounted so as to be fixed with respect to the second barrel side, the first and second axles being in axial alignment with one another when the second barrel side is in the first disposition; and a trigger assembly disposed within the casing and having a trigger extending externally thereof for manual actuation, said trigger assembly, when manually actuated, being operable to selectively apply electrical power to the drive motor.

2. The combination of claim 1, and in which the glue stick holder includes a peripheral stop adjacent one end thereof, so that the peripheral stop is external of the heater assembly and remote from the nozzle assembly when the glue stick holder extends through the heater assembly.

3. The combination of claim 1, and in which the nozzle assembly includes a melted glue passageway extending longitudinally therethrough and terminating in an outlet, a first valve and a second valve serially disposed in said passageway so as to control the flow of glue melted from the glue stick therethrough to the outlet, first valve bias means for normally closing the first valve, and means for causing the second valve to open upon the opening of the first valve, so as to permit the flow of melted glue from the glue stick to the outlet, and to close the second valve when the first valve closes, so as to prevent the further flow of melted glue contained in the passageway to the outlet.

4. The combination of claim 3, and in which the glue stick holder includes a peripheral stop adjacent one end thereof, so that the peripheral stop is external of the heater assembly and remote from the nozzle assembly when the glue stick holder extends through the heater assembly.

5. A glue gun, adaptable for either cordless or corded operation, comprising:

a pistol-type gun casing with a base and a barrel with a longitudinal axis terminating in a nozzle assembly, the base being adapted to receive electrical power from a power source which is either a battery or an ac to dc converter;

a heater assembly including an electric heater element adapted to melt glue contained in a glue stick;

a drive motor;

electrical circuit means for applying electrical power to the heater element and, selectively, to the drive motor;

a feed roller disposed within the casing so as to be transverse to and in longitudinal alignment with the barrel and operable, in response to the selective application of electrical power to the drive motor, to be rotated thereby in a preselected direction;

a selectively removable glue stick holder extending through the heater assembly in longitudinal alignment with and between the nozzle assembly and the feed roller so that the glue stick, when disposed within the glue stick holder, extends from the nozzle assembly onto and beyond the feed roller, said glue stick holder including a peripheral stop formed thereon so as to disposed between the heater assembly and the feed roller when the glue stick holder extends through the heater assembly;

means for pressing the glue stick, when so disposed, against the feed roller so as to cause the glue stick to be urged toward the nozzle assembly in response to rotation of the feed roller in the preselected direction comprising (a) a hinge extending longitudinally along a portion of the barrel top, the barrel having a first barrel side which is fixed with respect to the heater assembly and a second barrel side which is connected to said hinge so as to be selectively rotatable through an arc between a first disposition which is adjacent the heater assembly and a second disposition which is remote from the heater assembly to permit access to the glue stick holder, (b) first and second roller elements which are mirror images of one another and whose outer glue stick engaging surfaces are complementary to their respective peripheral portions of the glue stick to be contacted, (c) first axle means on which the first roller element is rotatably mounted so as to be fixed with respect to the first barrel side and transverse to the glue stick, and (d) second axle means on which the second roller element is rotatably mounted so as to be fixed with respect to the second barrel side, the first and second axles being in axial alignment with one another when the second barrel side is in its first disposition, and (e) locking means fixed to the second barrel side for normally retaining the second barrel side in its first disposition; and a trigger assembly disposed within the casing and having a trigger extending externally thereof for manual actuation, said trigger assembly, when manually actuated, being operable to selectively apply electrical power from the power source to the drive motor.

6. The combination of claim 5, and in which the nozzle assembly includes a melted glue passageway extending longitudinally therethrough and terminating in an outlet, a first valve and a second valve serially disposed in said passageway so as to control the flow of glue melted from the glue stick therethrough to the outlet, first valve bias means for normally closing the first valve, and means for causing the second valve to open upon the opening of the first valve, so as to permit the flow of melted glue from the glue stick to the outlet, and to close the second valve when the first valve closes, so as to prevent the further flow of melted glue contained in the passageway to the outlet.

* * * * *